US005708946A

United States Patent [19]

Cahill et al.

[11] Patent Number: 5,708,946

[45] Date of Patent: Jan. 13, 1998

[54] FUSER SKIVE MECHANISM MOUNTING FOR FACILITATING JAM CLEARANCE

[75] Inventors: David F. Cahill, Rochester; Terry N. Morganti, Brockport; James D. Shifley, Spenceport, all of N.Y.

[73] Assignee: Eastman Kodak Company, Rochester, N.Y.

[21] Appl. No.: 659,483

[22] Filed: Jun. 6, 1996

Related U.S. Application Data

[60] Provisional application No. 60/006,153 Nov. 2, 1995.

[51] Int. Cl.[6] ..... G03G 15/20

[52] U.S. Cl. ..... 399/323; 271/307; 399/22; 399/122

[58] Field of Search ..... 399/22, 107, 122, 399/323; 271/307; 219/216

[56] References Cited

U.S. PATENT DOCUMENTS 4,475,804 10/1984 Kanno et al. ..... 399/323
5,532,810 7/1996 Cahill ..... 399/323

FOREIGN PATENT DOCUMENTS 2-158785 6/1990 Japan .

*Primary Examiner*—Arthur T. Grimley
*Assistant Examiner*—Sophia S. Chen
*Attorney, Agent, or Firm*—Lawrence P. Kessler

[57] ABSTRACT

A fuser assembly including a pair of rollers in nip relation to transport a receiver member along a travel path therebetween and permanently fix a marking particle image to a such a transported receiver member, a skive mechanism for stripping a receiver member adhering to a fuser assembly roller from such roller, and a mounting for the skive mechanism. The skive mechanism mounting includes a support for the skive mechanism. The skive mechanism is selectively moved about the support mechanism into operative relation with the roller of the fuser assembly adjacent to the travel path. The skive mechanism is urged in a direction, in opposition to the selective movement of the skive mechanism, from operative relation with the roller of the fuser assembly toward a location remote from the travel path, whereby clearance of a receiver member jam in the fuser assembly is facilitated.

37 Claims, 11 Drawing Sheets

FUSER SKIVE MECHANISM MOUNTING FOR FACILITATING JAM CLEARANCE

CROSS REFERENCE TO RELATED APPLICATION

Reference is made to and priority claimed from U.S. Provisional Application Serial No. US 60/006,153, filed 02 Nov. 1995, entitled FUSER SKIVE MECHANISM MOUNTING FOR FACILITATING JAM CLEARANCE.

BACKGROUND OF THE INVENTION

The present invention relates in general to a skive mechanism for stripping receiver members from fuser assembly rollers of reproduction apparatus and, more particularly, to a mounting for a fuser assembly roller skive mechanism which enables the skive mechanism to be readily moved to a location relative to the fuser assembly rollers to facilitate jam clearance.

In typical commercial reproduction apparatus such as electrostatographic copier/duplicators, printers, or the like, a latent image charge pattern is formed on a uniformly charged dielectric member. Pigmented marking particles are attracted to the latent image charge pattern to develop such image on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser assembly at a downstream location. At the fuser assembly, the image is fixed to the receiver member by heat and/or pressure to form a permanent reproduction on such receiver member.

One type of fuser assembly, utilized in the above-mentioned typical reproduction apparatus, includes at least one heated roller and at least one pressure roller (may also be heated) in nip relation with the heated roller. The fuser assembly rollers are rotated to transport a receiver member, bearing a marking particle image, through the nip between the rollers. The pigmented marking particles of the transferred image on the surface of the receiver member soften and become tacky due to the heat from the heated roller. Under the pressure, the softened tacky marking particles attach to each other and are at least partially imbibed into the interstices of the fibers at the surface of the receiver member. Accordingly, upon cooling, the marking particle image is permanently fixed to the receiver member.

It sometimes happens that under certain conditions, the receiver member may adhere to one of the rollers of the fuser assembly. For example, marking particles may stick to the peripheral surface of the heated roller and result in the receiver member adhering to such roller; or the marking particles may stick to the heated roller and subsequently transfer to the peripheral surface of the pressure roller, resulting in the receiver member adhering to the pressure roller. Such condition may cause jams in the fuser assembly and result in a failure to complete the reproduction cycle. Therefore, a skive mechanism including skive fingers (or separator pawls) has been employed to engage the respective peripheral surfaces of the fuser assembly rollers to strip any adhering receiver member from the rollers in order to substantially prevent receiver member jams in the fuser assembly.

Typically, a fuser assembly skive mechanism includes a plurality of skive fingers. The skive fingers are generally formed as elongated members respectively having a relatively sharp leading edge urged into engagement with a fuser assembly roller. For example, the skive fingers may be thin, relatively flexible, metal shim stock. In the copending U.S. patent application Ser. No. 08/335,933 (filed Nov. 8, 1994, in the name of Cahill), now U.S. Pat. No. 5,532,810, a skive mechanism is shown and described which comprises relatively flexible skive fingers. A major portion of the skive fingers are supported so as to increase the rigidity thereof. The skive finger support is mounted, relative to a fuser assembly roller, such that in a first position the skive fingers engage the roller with the skive finger support spaced from the roller, and in a second position the skive fingers engage the roller with the skive finger support in engagement with the roller to limit flexing of the skive fingers to substantially prevent gouging of the peripheral surface of the fuser assembly roller or damage to the skive finger.

The respective leading edge of each of the skive fingers is directed in the opposite direction to rotation of the fuser assembly roller with which such skive finger is associated so as to act like a chisel to strip any receiver member adhering to such roller from the peripheral surface thereof. However, if the marking particle image is particularly heavy, the receiver member may adhere to a fuser assembly roller with such force that engagement with the skive fingers does not completely strip the receiver member from the roller. When a receiver member transported through the fuser assembly is only stripped from a roller by some of the skive fingers (and not by others), the receiver member will cause a jam in the fuser assembly. This destroys the reproduction formed on the receiver member and shuts down the reproduction apparatus. Moreover, as the receiver member moves with the fuser assembly roller to which it adheres, the stripped portions of the receiver member are forced into engagement with their associated skive fingers by the non-stripped portions of the receiver member. Removal of the jammed receiver member is difficult, and potentially dangerous for the operator, because of the limited access to the receiver member in the vicinity of the skive mechanism relative to the fuser assembly rollers and receiver member travel path.

SUMMARY OF THE INVENTION

In view of the foregoing discussion, this invention is directed to a fuser assembly including at least one roller for transporting a receiver member along a travel path, toward a downstream transport assembly, and permanently fix a marking particle image to a such a transported receiver member, a skive mechanism for stripping a receiver member adhering to a fuser assembly roller from such roller, and a mounting for the skive mechanism for facilitating jam clearance in the fuser assembly. The skive mechanism mounting includes a support for the skive mechanism. The skive mechanism is selectively moved about the support mechanism into operative relation with the roller of the fuser assembly adjacent to the travel path. The skive mechanism is urged in a direction, in opposition to the selective movement of the skive mechanism, from operative relation with the roller of the fuser assembly toward a location remote from the travel path, whereby clearance of a receiver member jam in the fuser assembly is facilitated.

In one embodiment of the mounting for the skive mechanism, the skive mechanism mounting includes a support having a bracket, for example attached to the downstream transport assembly, and a pivot shaft carried by the bracket. The skive mechanism is attached to the pivot shaft. The skive mechanism is selectively moved, relative to the bracket, to rotate the skive mechanism about the pivot shaft to locate the skive mechanism in operative relation with the fuser assembly roller adjacent to the travel path. A link, connected to the skive mechanism, is impelled to move in a direction, relative to the bracket, to rotate the skive mechanism in a direction about the pivot shaft in opposition to the selective movement of the skive mechanism, from operative relation with the roller of the fuser assembly toward a location remote from the travel path, whereby clearance of a receiver member jam in the fuser assembly is facilitated. Further, the skive mechanism is impelled to rotate in a direction about the pivot shaft, subsequent to the skive mechanism being rotated in the opposite direction, when the downstream transport assembly is moved out of operative relation with the receiver member travel path.

In an alternate embodiment of the mounting for the skive mechanism, the skive mechanism mounting includes a support having a bracket, and a pivot shaft carried by the bracket. The bracket is pivotably supported for rotation about the longitudinal axis of the fuser assembly roller. The skive mechanism is attached to the pivot shaft. The skive mechanism is urged by a spring, for example attached to the downstream transport assembly, adapted to engage the bracket and urge the bracket to rotate in a first direction about the longitudinal axis of the fuser assembly roller to locate the skive mechanism in operative relation with the fuser assembly roller. The skive mechanism is moved by moving the spring to a remote location, out of engagement with the bracket, so as to enable the bracket to rotate in a second direction, substantially opposite the first direction, under the influence of gravitational forces, about the longitudinal axis of the fuser assembly roller to locate the skive mechanism out of operative relation with the fuser assembly roller. Further, a guide plate is provided having a marginal edge in juxtaposition with the peripheral surface of the fuser assembly roller. The guide plate has a portion at an elevation below the elevation of the plane of the skive mechanism when the skive mechanism is in operative relation with the fuser assembly roller, and at an elevation above the elevation of the plane of the skive mechanism when the bracket supporting the skive mechanism is in engagement with the stop member and the skive mechanism is out of operative relation with the fuser assembly roller.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 3:
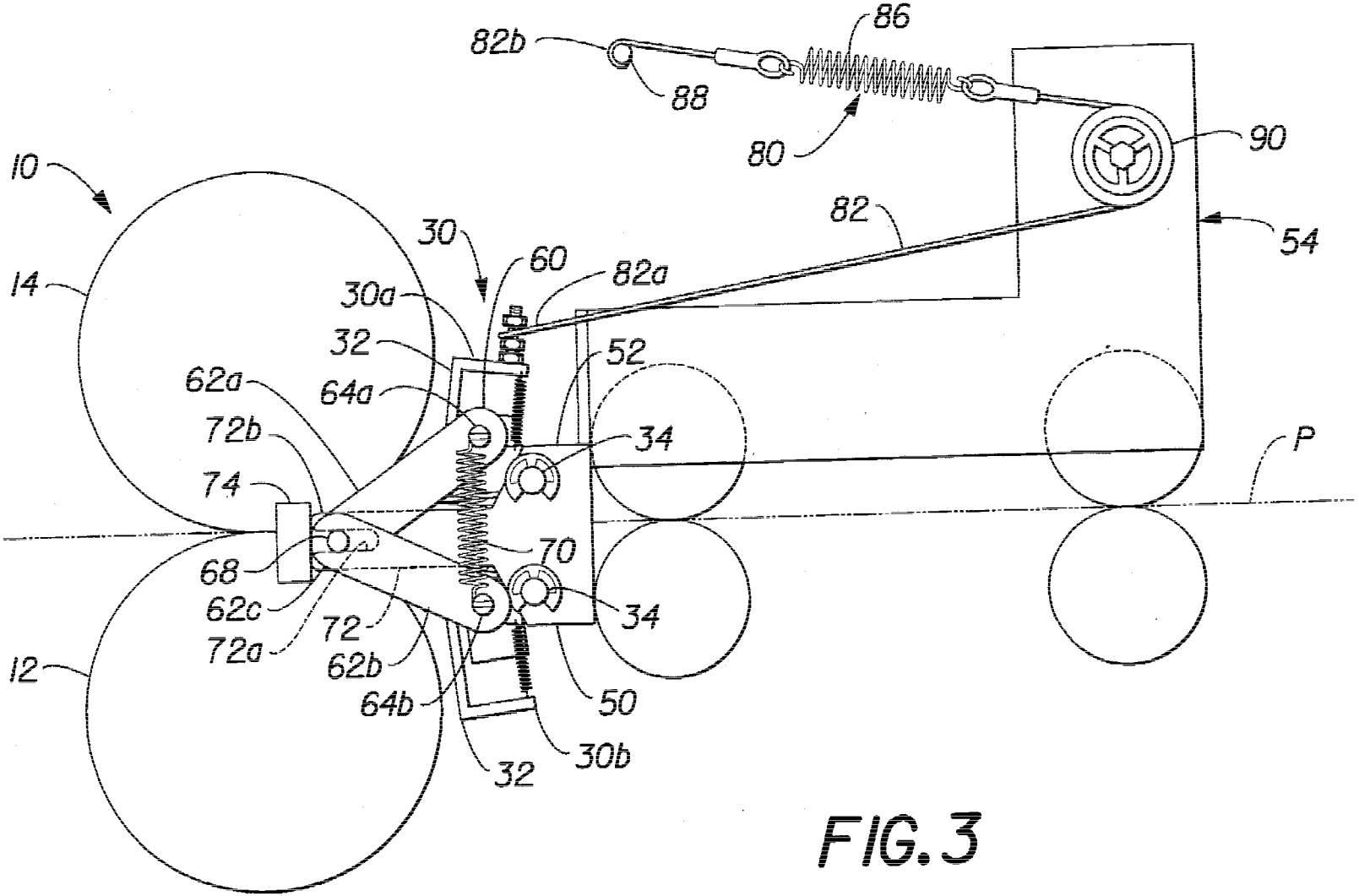
FIG. 3 is a side elevational view of the skive mechanism, with the mounting for facilitating jam clearance, according to this invention, viewed in the direction of arrows 3—3 of FIG. 2, the skive mechanism being shown in the operative relation to the rollers of the fuser assembly.
Figure 4:
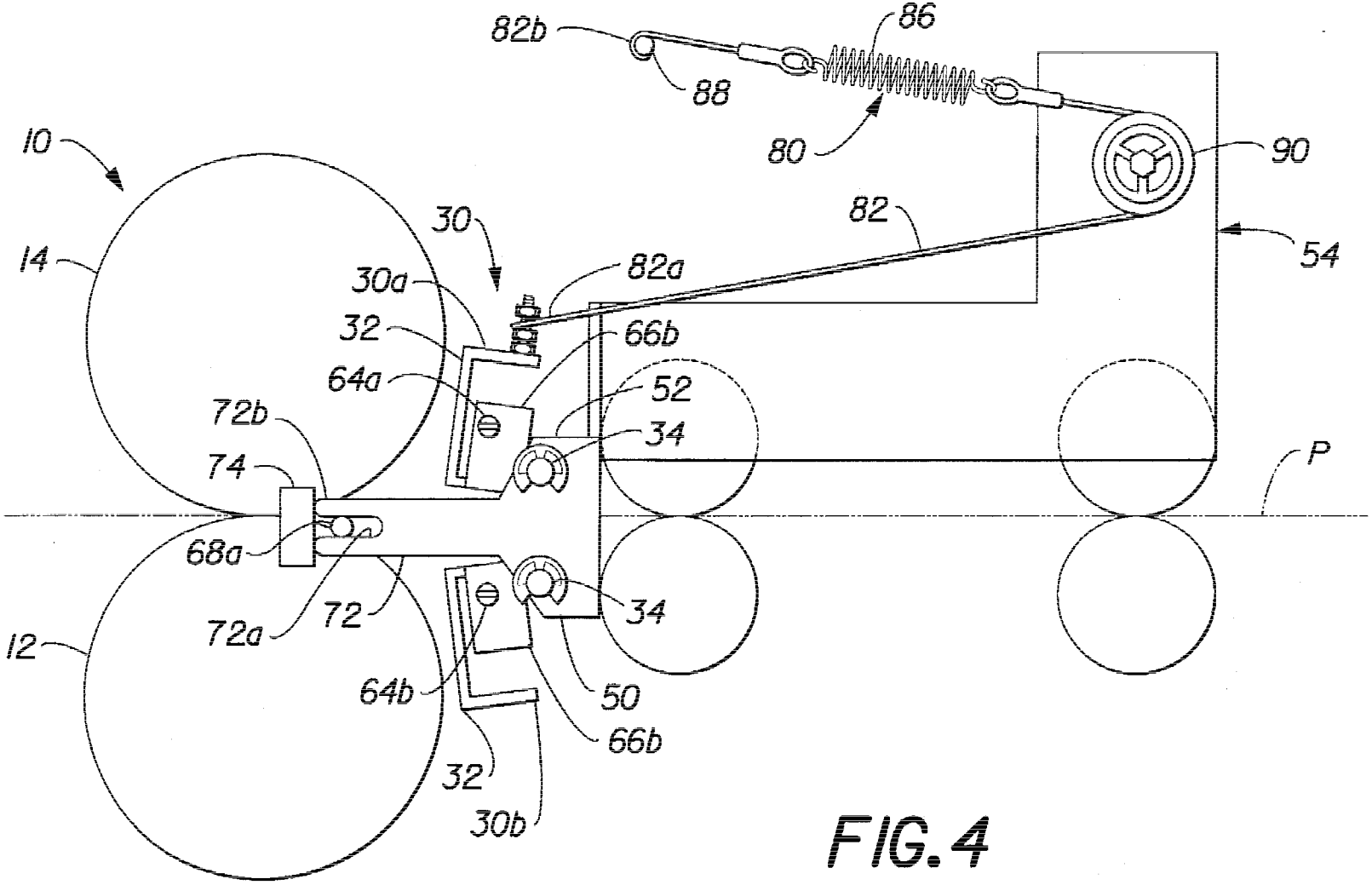
FIG. 4 is a side elevational view, similar to FIG. 3, of the skive mechanism, with the mounting for facilitating jam clearance, partly in cross-section, taken along the lines 4—4 of FIG. 2.

Referring now to the accompanying drawings, a typical fuser assembly is shown for a reproduction apparatus of the electrostatographic type, the fuser assembly being designated generally by the numeral 10. The fuser assembly 10 includes a fuser roller 12 in nip relation with a pressure roller 14. Rotation of the fuser assembly rollers by any suitable drive mechanism (not shown) will serve to transport a receiver member, bearing a marking particle image along a travel path P (see FIG. 3) through the nip under the application of heat and pressure. The receiver member may be, for example, a sheet of plain bond paper, or transparency material. The heat will plasticize the marking particles of the image; and the pressure will force the particles into intimate contact so as to cause the particles to be at least partially imbibed into the fibers at the surface of the receiver material. Thus, when the marking particles cool, they are permanently fixed to the receiver member in an image-wise fashion.

While not specifically shown in the drawings, it is well known that in the typical fuser assembly 10 the fuser roller 12 includes a core with a cylindrical fusing blanket supported on the core. The blanket is typically made of a robber material particularly formulated to be heat conductive or heat insulative dependent upon whether the fuser heat source is located within the core or in juxtaposition with the periphery of the blanket. The pressure roller 14 has a hard outer shell typically made of metal, such as aluminum or steel for example. The shell may also have a well known suitable surface coating (not shown) applied thereto to substantially prevent offsetting of the marking particle image to the pressure roller 12. A cleaning assembly (not shown) may be provided to remove residual marking particle, paper fibers, and dust from the fuser assembly rollers. Of course, other fuser assemblies (such as those utilizing rollers, belts, or a combination thereof, for example) are suitable for use with this invention.

Figure 1:
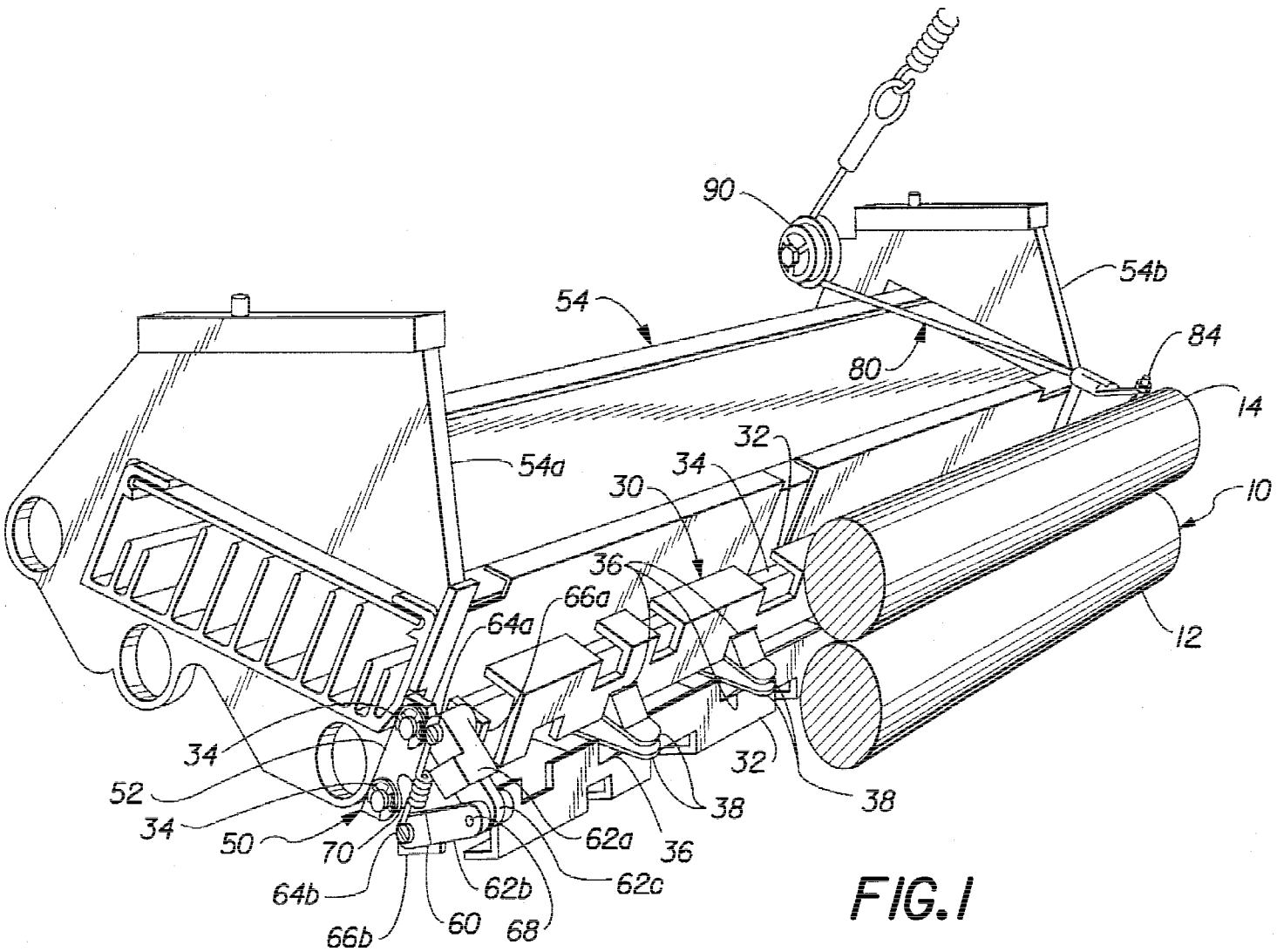
FIG. 1 is a view in perspective of a fuser assembly and skive mechanism, with the mounting for facilitating jam clearance, according to this invention, the skive mechanism being shown in an operative relation to the rollers of the fuser assembly.
Figure 2:
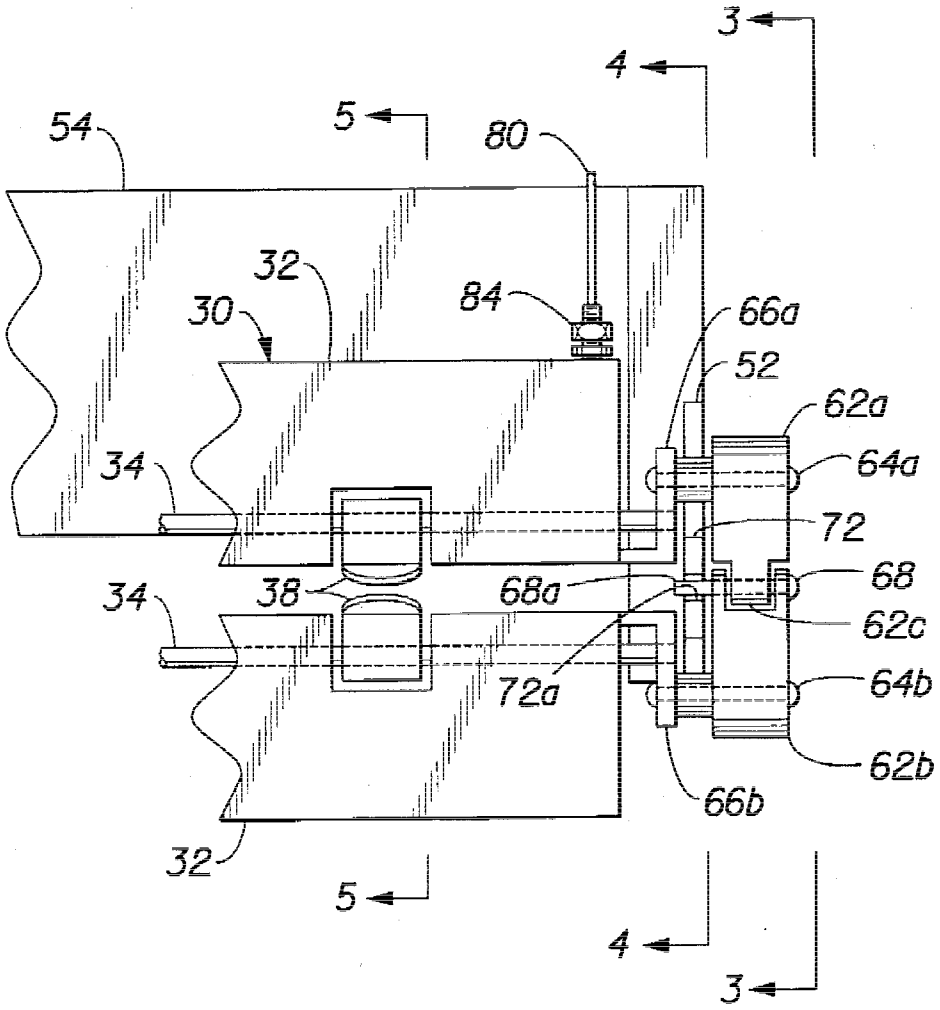
FIG. 2 is a front elevational view of a portion of the skive mechanism, with the mounting for facilitating jam clearance, according to this invention, as shown in FIG. 1.
Figure 5:
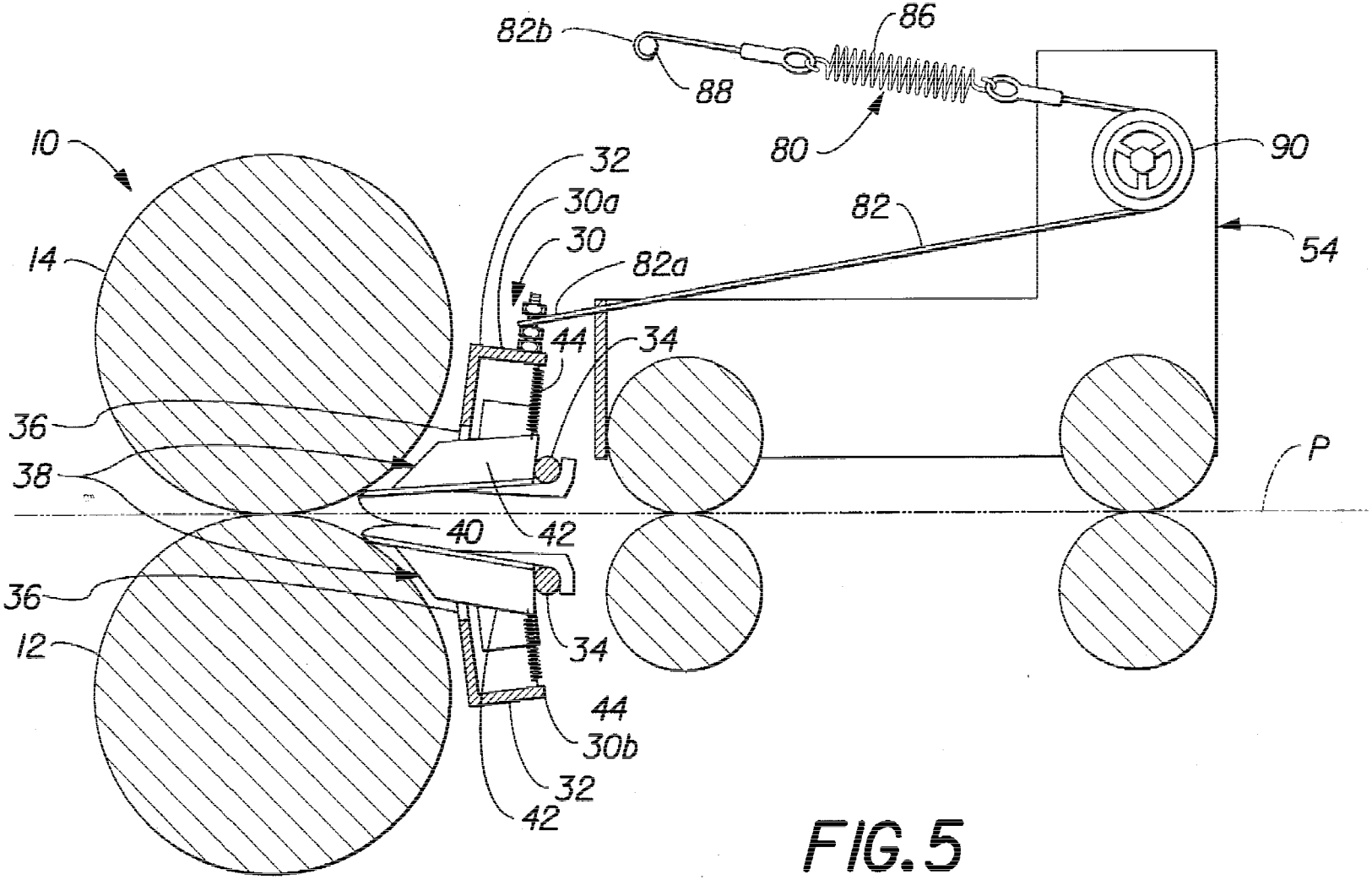
FIG. 5 is a side elevational view, similar to FIG. 3, of the skive mechanism, with the mounting for facilitating jam clearance, partly in cross-section, taken along the lines 5—5 of FIG. 2.

As noted above, under certain circumstances, such as when fusing heavy marking particle images, the receiver member may adhere to one or the other of the fuser assembly rollers (i.e., fuser roller 12 or pressure roller 14). Therefore, a skive mechanism designated generally by the numeral 30 is provided (best seen in FIGS. 1, 2, and 5). The skive mechanism 30, for example such as that fully shown and described in the aforementioned U.S. patent application Ser. No. 08/335,933, includes a pair of assemblies 30*a* and 30*b* respectively associated with the fuser assembly rollers 12 and 14. The assemblies 30*a*, 30*b*, which are essentially mirror images of one another, include a mounting bracket 32 supported in a predetermined spatial relation with respective fuser assembly rollers. The bracket 32 captures a shaft 34 (see FIG. 5). The shaft 34 extends for substantially the full longitudinal dimension of the bracket 32, and is retained in a suitable manner such that the longitudinal axis of the shaft is substantially parallel to the longitudinal axes of the fuser assembly rollers.

Each of the brackets 32 defines a plurality of openings 36. A plurality of skive members 38 are associated with the plurality of openings respectively. Each skive member 38 includes a skive finger 40 and a finger support 42 (see FIG. 5). The skive finger 40 is formed as an elongated, relatively flexible element having a sharp chisel-like lead edge, while the skive finger support 42 is formed as a molded plastic body. The molded plastic body of the skive finger support 42 captures a major segment of the skive finger 40, with the lead edge of the finger extending beyond the body associated therewith. Further, the molded plastic body of the skive finger support 42 is adapted to be received on a shaft 34. Accordingly, each of the skive finger supports 42, and thus the respective skive fingers 40, is mounted on a shaft 34 so as to extend through an associated opening 36 in the bracket 32.

The lead edges of the respective skive members 38 are urged into contact with the peripheral surface of the associated fuser assembly roller by tension springs 44 (see FIG. 5) connected between the body of each of the skive finger supports and the associated mounting bracket 32. The tension springs 44 provide sufficient force to establish a low attack angle for the skive fingers with the peripheral surface of the fuser assembly rollers whereby a receiver member adhering to a roller will normally be stripped from such roller by the skive fingers.

However, when a receiver member adheres to the surface of a fuser assembly roller, with sufficient force to overcome the stripping force of at least some of the skive members 38 of the skive mechanism 30, a jam condition may result. It is then necessary to clear the jam (i.e., remove the receiver member) before further reproduction can occur. Therefore, according to this invention, a particular mounting, according to this invention, for the skive mechanism 30 is provided to enable the skive mechanism to be moved to a location where receiver member removal is facilitated so that jam clearance can be readily accomplished.

A first embodiment for the skive mechanism mounting, according to this invention, as shown in FIGS. 1–7, is designated in the drawings by the numeral 50. The mounting 50 includes a pair of support brackets 52 extending respectively from the end plates 54*a*, 54*b* of a receiver member cooler assembly 54. The cooler assembly 54, located immediately downstream (in the direction of travel of the receiver member along the path P) from the fuser assembly 10, acquires receiver members bearing fixed marking particle images and transports such members toward an output location for operator retrieval. During the transport cycle, the cooler assembly 54 acts to positively draw heat from the transported receiver member, while holding the member in a flat condition, so that the receiver member is delivered to the output location substantially without curl and at room temperature. On jam clearance, the cooler assembly 54 is movable away from the fuser assembly 10 to a location remote from the travel path P (see FIG. 7) in order to enable ready access to the path and the fuser assembly for removing jammed receiver members.

The brackets 52 support the shafts 34 of the skive mechanism 30. As mentioned above in the general description of the skive mechanism 30, the skive members 38 and brackets 32 are pivotably supported on the shafts 34 for movement about the respective longitudinal axes of the associated shafts. A pivot actuation linkage 60 selectively acts on the skive members 38, through the brackets 32, to move the skive members in a direction about the shafts 34 respectively into operative relation with the respective fuser assembly rollers 12, 14.

The actuation linkage 60 includes a pair of assemblies located at the outboard ends respectively of the skive mechanism 30 (only one end shown in the drawings). Each of the assemblies has a first arm 62*a* and an interconnected second arm 62*b*. The first arm 62*a* is pivotably supported adjacent one end on a pin 64*a*. The pin is carried by a tab 66*a* extending from the end of the upper bracket 32 substantially at a right angle thereto. Likewise, the second arm 62*b* is pivotably supported adjacent one end on a pin 64*b*. The pin is carried by a tab is 66*b* extending from the end of the lower bracket 32 substantially at a right angle thereto. Since the brackets 32 are respectively supported on the shafts 34 (as described above), the pins 64*a* (64*b*) carried by the tabs 66*a* (66*b*) of the brackets are a fixed predetermined radial distance from the longitudinal axes of the shafts 34 respectively.

The first arm 62*a* and the second arm 62*b* of the actuation linkage 60 are interconnected adjacent their respective ends opposite the pin-supported ends to form a knuckle joint 62*c* about a knuckle pin 68. A tension spring 70 is connected to the respective pins 64*a*, 64*b* to impel the arms 62*a*, 62*b* to move about the pivot pin 68 toward one another. The action of the tension spring 70 on the arms 62*a*, 62*b* also serves to impel the brackets 32, respectively connected to the links 62*a*, 62*b* by the pins 64*a*, 64*b*, to move respectively about the shafts 34 in an appropriate direction to position the skive fingers of the skive members 38 remote from operative engagement with the rollers 12, 14 of the fuser assembly 10.

The knuckle pin 68 has an extended portion 68*a* (see FIGS. 2 and 3) which rides in a slot 72*a* formed in a guide member 72. The guide member 72 is attached to (or forms an integral part of) the bracket 52. The slot 72*a* is oriented so as to be perpendicular to a plane including the longitudinal axes of the shafts 34. The forward end 72*b* of the guide member 72 is adapted to engage a stop member 74 (see FIG. 3) located in a predetermined fixed relation to the rollers of the fuser assembly 10. When the end 72*b* of the guide member 72 is in engagement with the stop member 74, the cooling member 54 is accurately positioned relative to the receiver member transport path P, immediately downstream in the direction of receiver member travel, from the fuser assembly 10 so as to acquire and transport a receiver member along such path. Of course, by the particular operative location of the cooling member 54 to the fuser assembly 10, the skive assembly 30 attached to the cooling member, is also accurately located relative to the fuser assembly.

The lengths of the arms 62*a*, 62*b* are preselected such that when the forward end 72*b* of the guide member 72 is engaged with the stop member 74, the knuckle joint 62*c* of the interconnected arms of the actuation linkage 60 also engages the stop member. The respective distance between the longitudinal axis of each of the shafts 34 and the is stop member 74 (measured in a plane including the longitudinal axis of a shaft 34 and the longitudinal axis of the knuckle pin 68) is less than the sum of the distance from the longitudinal axis of a shaft 34 to the longitudinal axis of the pin 64*a* (64*b*) and the preselected length of the arm 62*a* (62*b*). The actuation linkage 60, as it engages the stop member 74, will move in a direction toward the cooling member 54, with the extension 68*a* of the knuckle pin 68 riding (guided) in the slot 72*a* of the guide member 72. Accordingly, the movement of the actuation linkage 60 in such described direction causes the arms 62*a*, 62*b* to pivot about the knuckle pin 68 in a direction opposite to the direction of the urging of the arms by the spring 70. Since the distances between the longitudinal axes of the pins 64*a* (64*b*) and the longitudinal axes of the shafts 34 respectively are fixed, the movement of the arms 62*a*, 62*b* cause the respective brackets 32 to pivot about the shafts 34 to move the skive members 38 into operative relation (contact) with the respective rollers 12, 14 of the fuser assembly 10.

Figure 6:
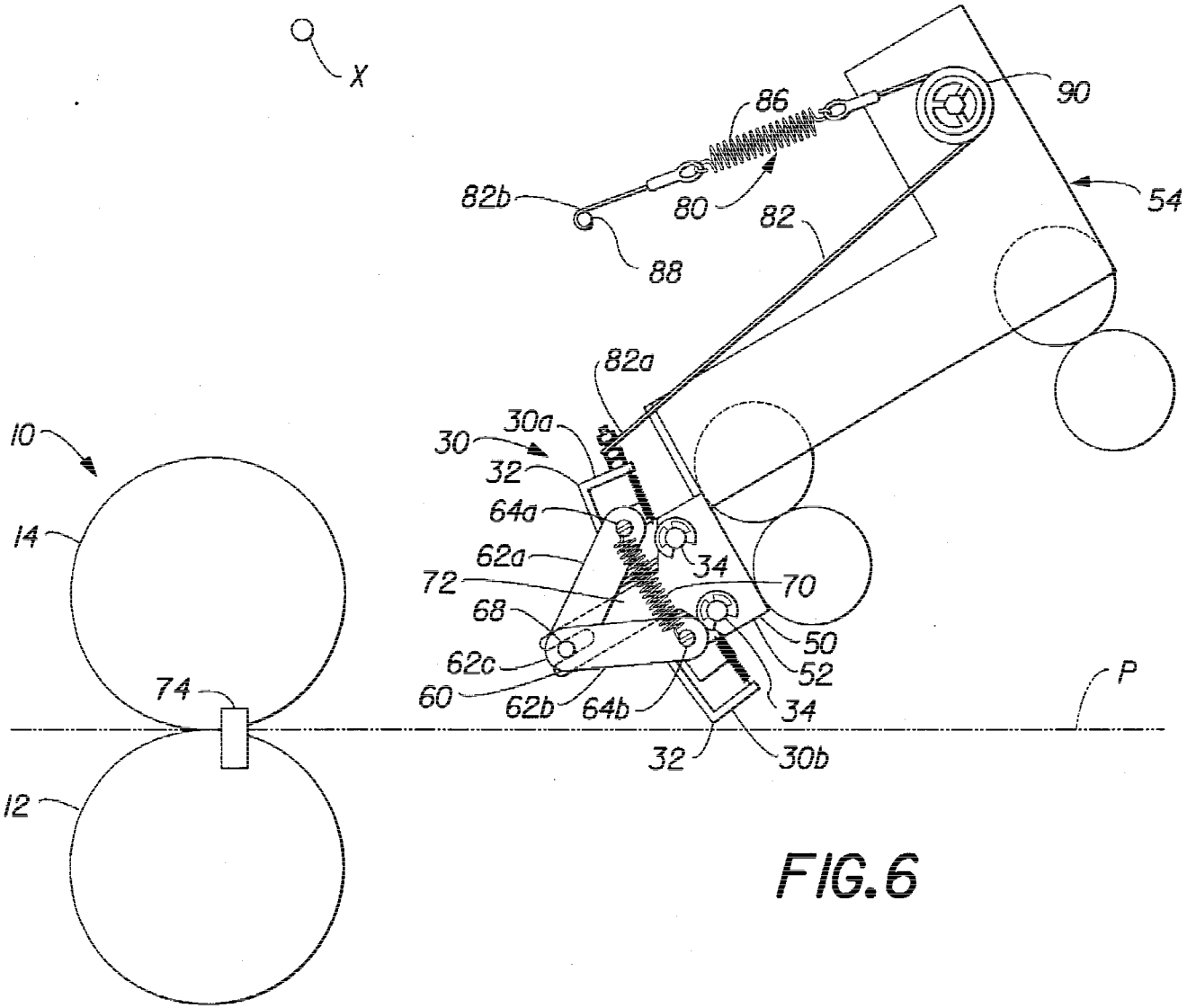
FIG. 6 is a side elevational view, similar to FIG. 3, of the skive mechanism, with the mounting for facilitating jam clearance, but showing the skive mechanism in an intermediate location between operative relation to the rollers of the fuser assembly and a remote location where jam clearance is facilitated.
Figure 7:
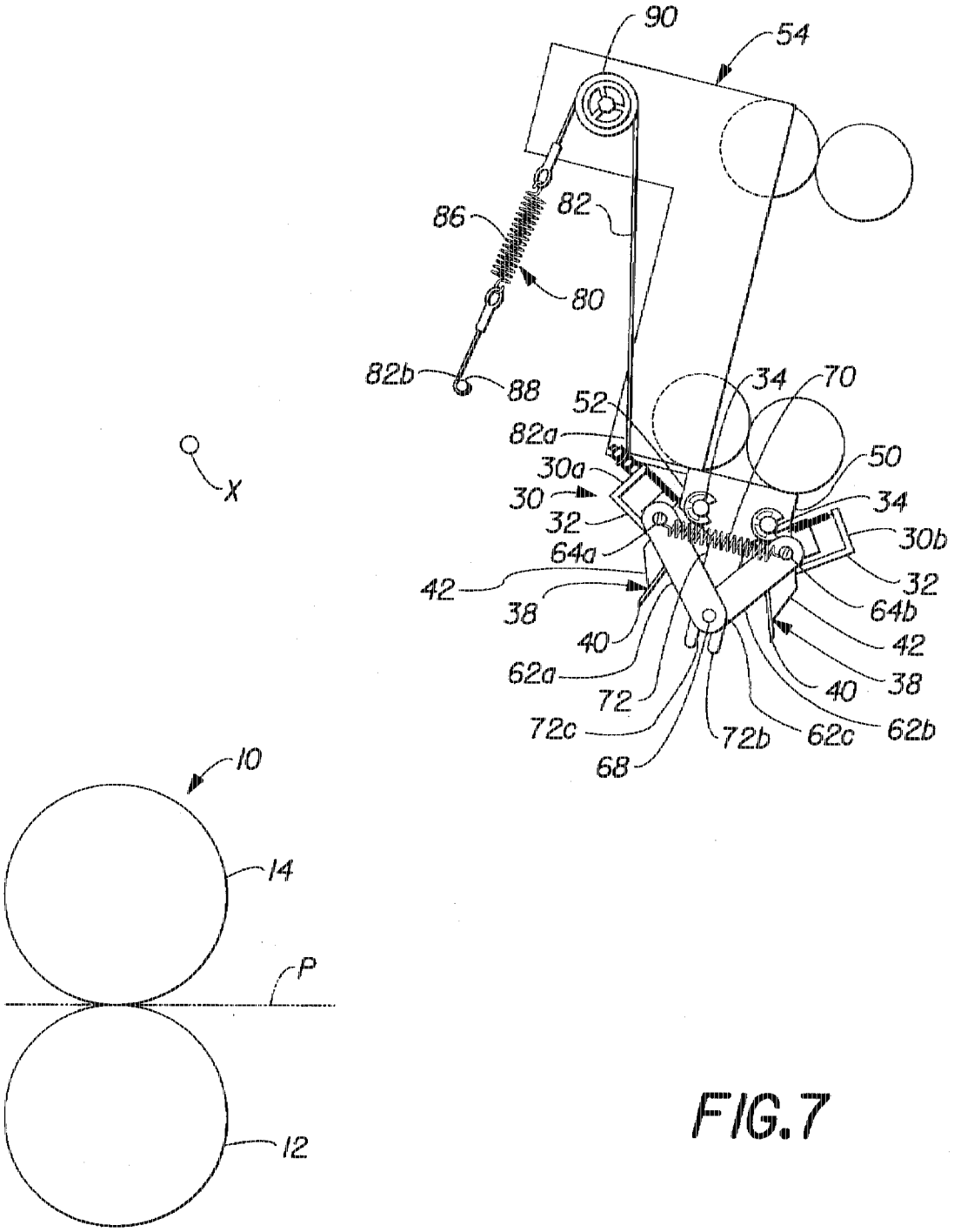
FIG. 7 is a side elevational view, similar to FIG. 3, of the skive mechanism, with the mounting for facilitating jam clearance, but showing the skive mechanism in a remote location where jam clearance is facilitated.
Figure 8:
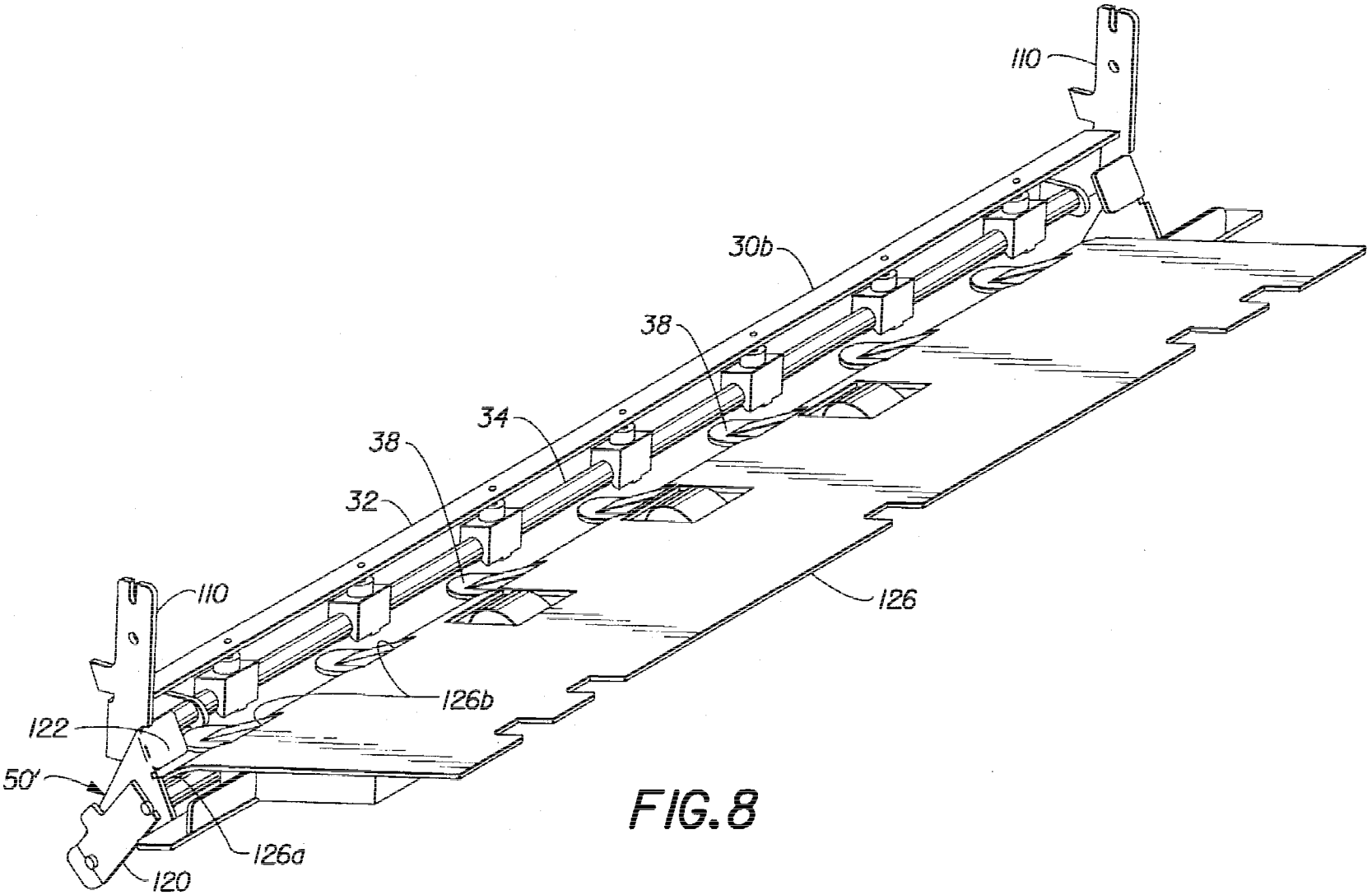
FIG. 8 is a view in perspective of a fuser assembly and skive mechanism, with an alternate mounting for facilitating jam clearance, according to this invention, the skive mechanism being shown in operative relation.

As noted above, particular care must be taken with the skive assembly 30 when clearing of a receiver member jam in the fuser assembly 10 becomes necessary. Referring to FIGS. 6 and 7, it can be seen that the cooling member 54 is movable to a remote position relative to the travel path P, about a pivot axis designated by the letter X. Of course, as the cooling assembly 54 moves to the remote position, it will carry the skive assembly 30 therewith. Accordingly, ready access to the fuser assembly 10 and the travel path P is provided to clear receiver member jams, while the skive assembly 30 is conveniently located out of the way to prevent damage thereto as the jam is cleared.

As the cooling member 54 moves away from the operative location relative to the fuser assembly (such operative location shown for example in FIG. 3), the skive assembly 30 will be moved away from the stop member 74. Due to the urging force exerted by the spring 70, the knuckle joint 62*c* of the actuation linkage 60 will, for a period of time during a short distance of movement of the cooling member (and attached skive assembly), remain in contact with the stop member. That is, the arms 62*a*, 62*b* will move toward one-another to move the knuckle joint 62*c* in a direction away from the cooling member 54. As such, the brackets 32 are pivoted about respective shafts 34 in a direction so that the skive members associated with the roller 12 and the skive members associated with the roller 14 will be moved out of operative relation therewith, and will be brought into contact with one-another. Thereafter, the arms 62*a*, 62*b* will be prevented from further rotation (in such last mentioned direction) about the axes of the shafts 34 respectively, and the skive assembly 30 will move as a unit with the cooling member 54 toward the remote position to enable access to the fuser assembly 10 to facilitate jam clearance.

A spring-and-cable mechanism, designated generally by the numeral 80, is connected to the skive assembly 30. The mechanism 80 includes a cable 82 having a tension spring 86 with a preselected spring constant located in line with the cable intermediate the ends thereof. One end 82*a* of the cable 82 of the mechanism 80 is attached by any suitable connector, such as a stud 84 for example, to the upper bracket 32 of the skive assembly 30 (see FIGS. 2, 6, and 7). The other end 82*b* of the cable 82 is attached by any suitable connector, such as a pin 88 for example, at a fixed location relative to the fuser assembly 10. The cable 82 of the mechanism 80 is threaded about a guide sheave 90 supported by the cooling member 54.

The fixed location of the end 82*b* of the cable 82 of the spring-and-cable mechanism 80 is preselected so as to be closer to the fuser assembly 10 than the distance of the pivot axis X to the fuser assembly. As described above, the cooling member 54 (and thus the attached skive assembly 30) is movable from the operative position (shown in FIG. 5) relative to the fuser assembly, through an intermediate position (shown in FIG. 6), to a remote position (shown in FIG. 7) from the receiver member travel path P to facilitate jam clearance. Accordingly, as the cooling member 54 is moved from the operative position to the remote position, the overall distance between the end 82*a* and the end 82*b* of the cable 82, when measured about the guide sheave 90, increases. Initially the spring constant of the spring 86 will enable the spring to accommodate for the increase in the overall distance between the ends of the cable. However, at some preselected distance, the spring 86 will become effective to act on the bracket 32 of the skive assembly 30 to pivot the bracket about the associated shaft 34. Due to the interconnection of the upper bracket and lower bracket of the skive assembly 30, through the actuation linkage 60 in the manner described above, the lower bracket will also be pivoted about the associated shaft 34. The direction of the pivoting movement of the respective brackets 34 is such that the associated skive members 38 will again move apart. This enables any receiver member caught between the skive members 38 to be released for ready removal and easy jam clearance.

Referring now to FIGS. 8–11, such figures show an alternate embodiment for the skive mechanism mounting, designated generally by the numeral 50'. In the skive mechanism mounting 50', the bracket 32 supporting the shaft 34 and skive members 38 associated with the roller 14 of the fuser assembly 10, has outboard extensions 110. The extensions 110 are connected in any suitable manner, such as by pins 112 for example, to a support mechanism 114 for the roller 14. The support mechanism 114 is mounted for pivotal movement about the pivot pin 116.

Figure 9:
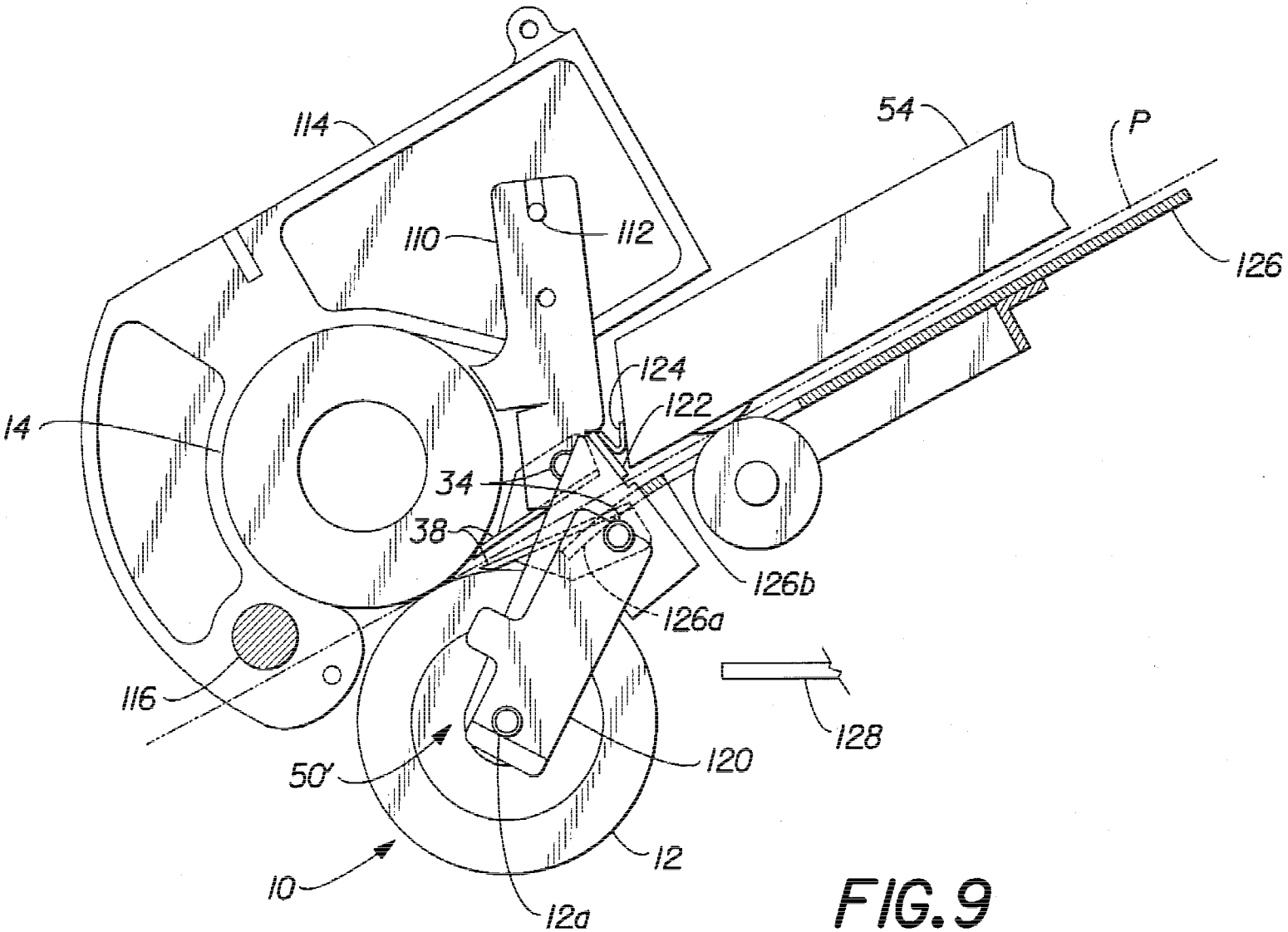
FIG. 9 is a side elevational view of the skive mechanism, with the alternate mounting for facilitating jam clearance, according to this invention, as shown in FIG. 8, the skive mechanism being shown in the operative relation to the rollers of the fuser assembly.
Figure 10:
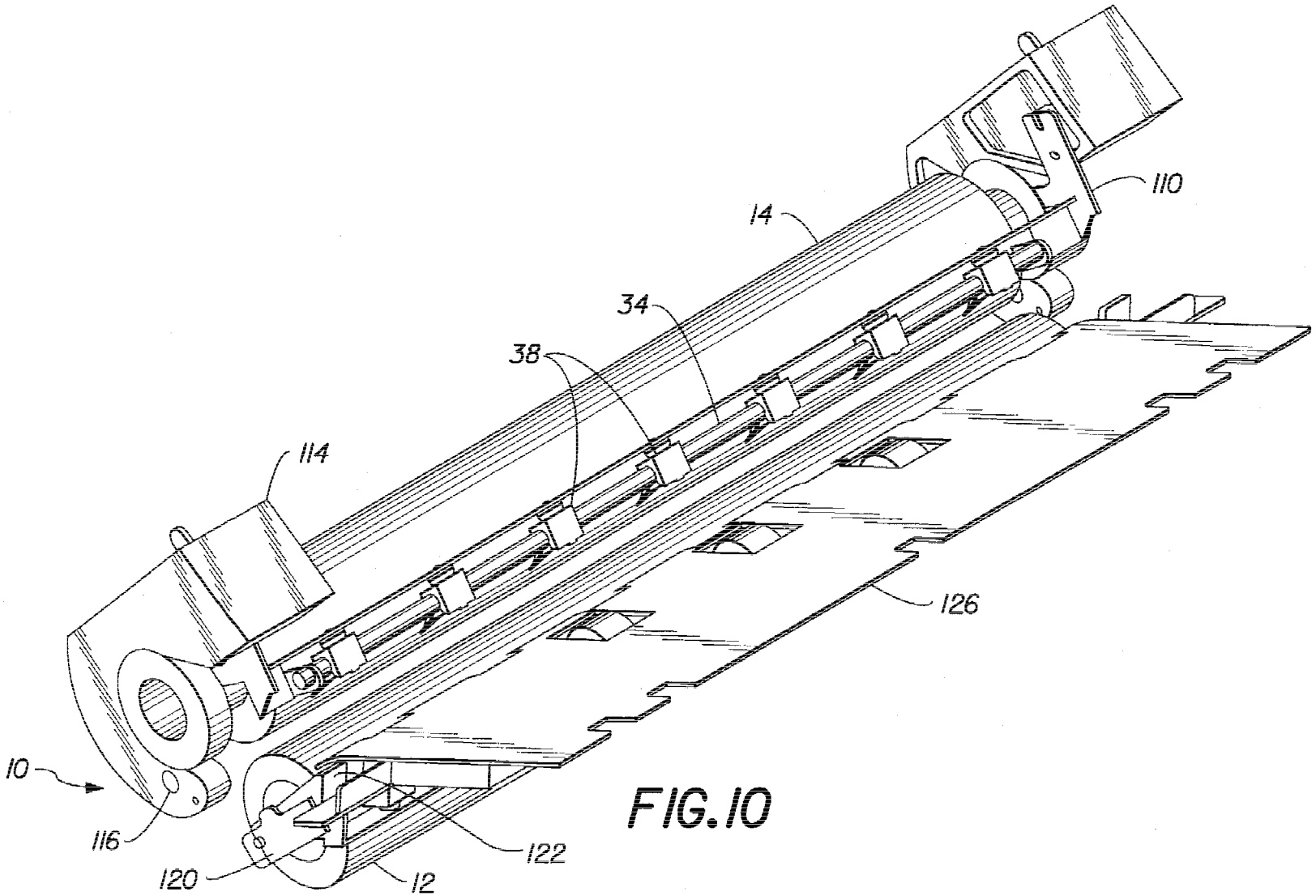
FIG. 10 is a view in perspective of a fuser assembly and skive mechanism, with an alternate mounting for facilitating jam clearance, according to this invention, the skive mechanism being shown in the remote location where jam clearance is facilitated.

In the normal course of operation, the support mechanism 114 maintains the roller 14 in operative relation with the roller 12 of the fuser assembly 10 (see FIG. 9). For jam clearance, the support mechanism 114 is rotated about the pivot pin 116 (counter-clockwise in FIG. 9) to move the roller 14 to a location remote from the roller 12, and the receiver member travel path (see FIG. 11). This will serve to release the nip pressure between the rollers 12 and 14, and thus facilitate access to any receiver member jam to be cleared from between such rollers. When the support mechanism 114 is rotated to the remote location as described, the outboard extensions 110 (and thus the shaft 34 and skive members 38 associated with the roller 14) are carried by the support mechanism to a location remote from the travel path P. As such, the skive members 38 associated with the roller 14 are located so as to enable ready access to the travel path for jam clearance and prevent damage to the skive members as the jammed receiver member is cleared.

The skive mounting mechanism 50' further includes a pair of brackets 120 mounted for free rotation about the outboard ends of the shaft 12*a* supporting the roller 12 of the fuser assembly. The brackets 120 support the bracket 32 and shaft 34 of the skive assembly 30 carrying the skive members 38 associated with the roller 12. The length of the brackets 120 is particularly selected such that the distance measured between the longitudinal axis of the fuser assembly roller 12 and the longitudinal axis of the supported shaft 34 is sufficient to properly locate the skive members 38 in operative relation with the roller 12. The brackets 120 have a face plate 122 which is adapted to be engaged by a compression spring-like member 124. For the purpose to be explained below, the face plate 122 is positioned to lie in a plane at an acute angle to a plane tangent to the roller 12. The member 124 is attached to the lead end of the cooling member 54 most closely adjacent to the fuser assembly 10. When the cooling member is located in operative relation with the fuser assembly and the receiver member travel path P (as shown in FIG. 9), the spring-like member 124 engages the face plate 122 to urge the brackets 120 in a direction to locate the skive members 38 associated with the roller 12 such that receiver members being fused by the fuser assembly 10 are normally properly stripped from the fuser assembly roller and directed into the travel path P.

A plate 126, positioned just beneath the travel path P in juxtaposition with the cooling member 54, aids in guiding the receiver members as they are stripped from the fuser assembly rollers 12, 14 and transported from the fuser assembly to the travel path P. The marginal edge of the plate 126 facing the fuser assembly 10 has a down-turned portion 126*a*, located closely adjacent to the surface of the roller 12. The portion 126*a* of the plate 126 has a series of slots 126*b* corresponding respectively to the skive members 38 associated with the roller 12. While the normal elevation of the plate 126 is substantially above the plane of such skive members (as best seen in FIG. 9), the down-turned portion 126*a* dips below the skive member plane, with the skive members extending thereabove through the slots 126*b*. In this manner, the stripped receiver members properly transition from the fuser assembly rollers to the travel path P.

Figure 11:
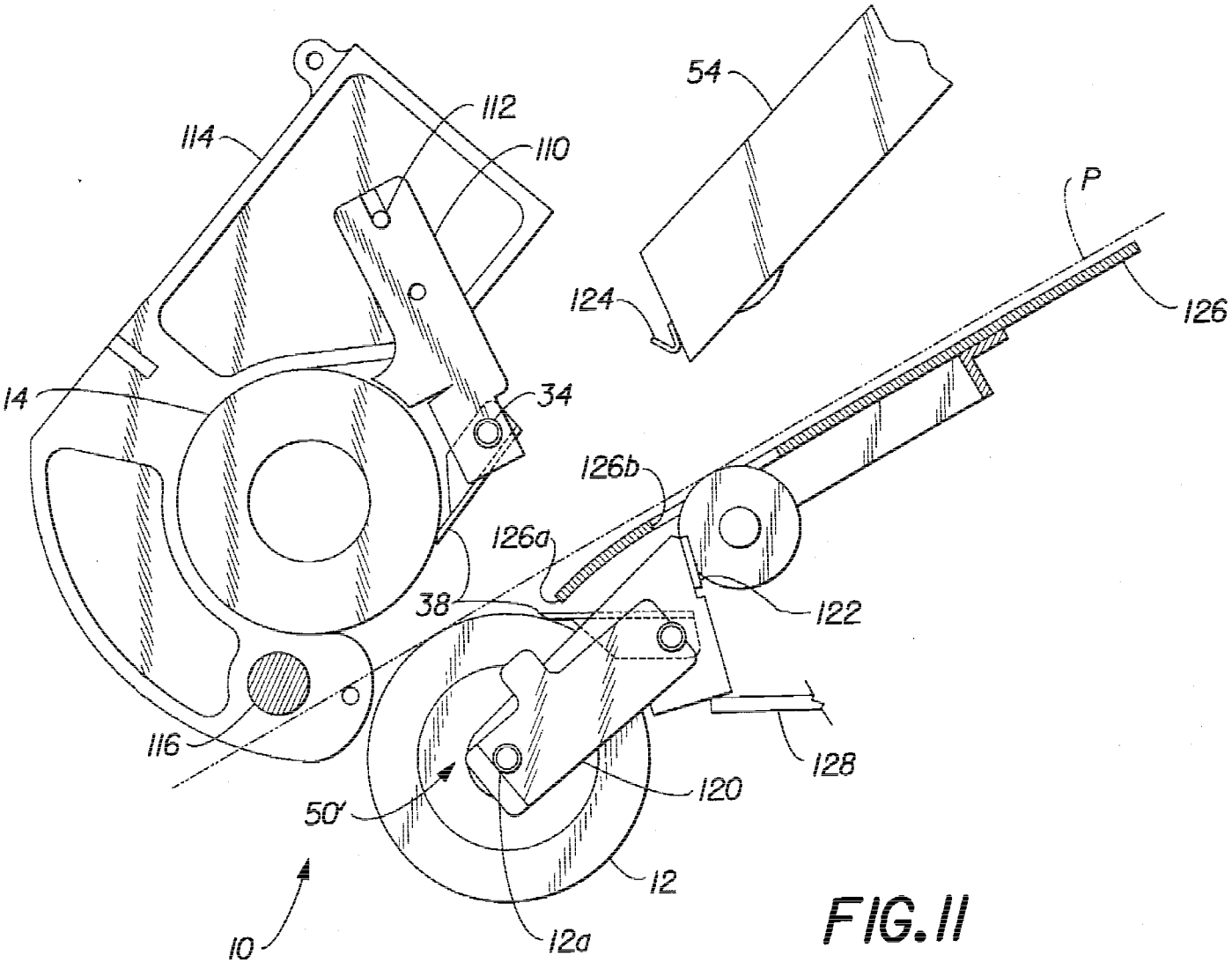
FIG. 11 is a side elevational view of the skive mechanism, with the alternate mounting for facilitating jam clearance, according to this invention, as shown in FIG. 10, the skive mechanism being shown in the remote location where jam clearance is facilitated.

As noted above, when a receiver member jam occurs that needs to be cleared from the fuser assembly 10, the cooling member 54 is moved to a position remote from the travel path P to enable ready access to the fuser assembly. When the cooling member 54 is moved to the remote position, the attached spring 124 is disengaged from the face plate 122 of the brackets 120. The brackets 120, and the associated elements of the skive assembly 30 associated with the roller 12, are then free to pivot about the shaft of the roller 12 (clockwise when viewed as in FIG. 11) under the influence of gravitational forces until the brackets engage the stop member 128. As best shown in FIG. 11, when the brackets are in engagement with the stop member 128, the skive members 38 in association with the roller 12 are located beneath the elevational level of the down-turned portion 126*a* of the receiver member guide plate 126. As a result, the plate 126 serves as a shield for such skive members. In this manner, such skive members are remote from, and out of the way of, the travel path P to enable ready access to the fuser assembly 10 to facilitate jam clearance, while at the same time the skive members are protected from damage as any jam is cleared.

Once a receiver member jam has been properly cleared from the fuser assembly 10, the cooling member may be returned to the location in operative relation with the fuser assembly. As the cooling assembly nears such operative relation location, the spring 124 engages the face plate 122 of the brackets 120. As noted above, the face plate 122 is at an acute angle to a tangent to the roller 12. Accordingly, the force exerted by the spring on the face plate has a component which serves to act in a direction to urge the brackets 120 to the position where the skive members 38 associated with the roller 12, carried by the brackets, are once again in operative relation with the fuser assembly roller 12. At substantially the same time, the support mechanism 114 for the fuser assembly roller 14 returns such roller to the location where the roller 14 is in operative relation with the roller 12 to form the fuser assembly nip. The fuser assembly 10 is then ready to resume the function of fusing marking particle images to receiver members in the normal manner.

The invention has been described in detail with particular reference to preferred embodiments thereof, but it will be understood that variations and modifications can be effected within the spirit and scope of the invention as set forth in the claims.

What is claimed is:

1. A fuser assembly including at least one roller for transporting a receiver member along a travel path, toward a downstream transport assembly, and permanently fix a marking particle image to a such transported receiver member, a skive mechanism for stripping a receiver member adhering to said fuser assembly roller from such roller, and a mounting for said skive mechanism, said skive mechanism mounting comprising:

a bracket pivotably supported for rotation about the longitudinal axis of said fuser assembly roller, and a pivot shaft carried by said bracket, said skive mechanism being supported by said pivot shaft;

means for selectively moving said skive mechanism about said pivot shaft into operative relation with said fuser assembly roller adjacent to said travel path; and means for urging said skive mechanism in a direction, in opposition to the selective movement of said skive mechanism by said moving means, from said operative relation with said fuser assembly roller toward a location remote from said travel path, whereby clearance of receiver member jams in said fuser assembly is facilitated, said urging means including a spring adapted to engage said bracket and urge said bracket to rotate in a first direction about the longitudinal axis of said fuser assembly roller to locate said skive mechanism in operative relation with said fuser assembly roller.

2. The skive mechanism mounting according to claim 1 wherein said moving means includes means for moving said spring to a remote location, out of engagement with said bracket, so as to enable said bracket to rotate in a second direction, substantially opposite said first direction, under the influence of gravitational forces, about the longitudinal axis of said fuser assembly roller to locate said skive mechanism out of operative relation with said fuser assembly roller.

3. The skive mechanism mounting according to claim 2 wherein said moving means further includes a stop member for limiting rotation of said bracket in said second direction.

4. The skive mechanism mounting according to claim 3 further including a guide plate having a marginal edge in juxtaposition with the peripheral surface of said fuser assembly roller, said guide plate having a portion at an elevation below the elevation of the plane of said skive mechanism when said skive mechanism is in operative relation with said fuser assembly roller, and at an elevation above the elevation of the plane of said skive mechanism when said bracket supporting said skive mechanism is in engagement with said stop member and said skive mechanism is out of operative relation with said fuser assembly roller.

5. The skive mechanism mounting according to claim 2 wherein said spring is attached to said downstream transport assembly.

6. The skive mechanism mounting according to claim 5 wherein said moving means further includes a stop member for limiting rotation of said bracket in said second direction.

7. The skive mechanism mounting according to claim 6 further including a guide plate having a marginal edge in juxtaposition with the peripheral surface of said fuser assembly roller, said guide plate having a portion at an elevation below the elevation of the plane of said skive mechanism when said skive mechanism is in operative relation with said fuser assembly roller, and at an elevation above the elevation of the plane of said skive mechanism when said bracket supporting said skive mechanism is in engagement with said stop member and said skive mechanism is out of operative relation with said fuser assembly roller.

8. A fuser assembly including at least one roller for transporting a receiver member along a travel path, toward a downstream transport assembly, and permanently fix a marking particle image to a such transported receiver member, a skive mechanism for stripping a receiver member adhering to said fuser assembly roller from such roller, and a mounting for said skive mechanism, said skive mechanism mounting comprising:

a bracket and a pivot shaft carried by said bracket, said skive mechanism being supported by said pivot shaft;

means for selectively moving said skive mechanism about said pivot shaft into operative relation with said fuser assembly roller adjacent to said travel path; and means for urging said skive mechanism in a direction, in opposition to the selective movement of said skive mechanism by said moving means, from said operative relation with said fuser assembly roller toward a location remote from said travel path, whereby clearance of receiver member jams in said fuser assembly is facilitated, said urging means for said skive mechanism including a link connected to said skive mechanism, means for impelling said link to move in a direction, relative to said bracket, to rotate said skive mechanism in a first direction about said pivot shaft, and said skive mechanism selective moving means including means for moving said link, relative to said bracket, to rotate said skive mechanism in a second direction about said pivot shaft, substantially opposite said first direction, to locate said skive mechanism in such operative relation with said fuser assembly roller, said link moving means including a stop member positioned at a predetermined location relative to said fuser assembly roller such that said stop member is adapted to become engaged with said link.

9. The skive mechanism mounting according to claim 8 wherein one end of said link is attached to said skive mechanism at a fixed predetermined radial distance from the longitudinal axis of said pivot shaft, and the opposite end of said link is constrained to move in a direction perpendicular to a plane including the longitudinal axis of said pivot shaft whereby, as said link is moved by said selective moving means in a particular direction, said skive mechanism rotates in a corresponding direction about said pivot shaft.

10. The skive mechanism mounting according to claim 9 wherein said urging means for said skive mechanism further includes a spring member attached to said link intermediate said ends thereof to urge said link for movement in a first direction.

11. The skive mechanism mounting according to claim 10 wherein said stop member, upon engagement with said link, moves said link, relative to said bracket, in a second direction substantially opposite said first direction to locate said skive mechanism in such operative relation with said fuser assembly roller by rotation of said skive mechanism about said pivot shaft.

12. A fuser assembly including a pair of rollers for transporting a receiver member therebetween, along a travel path toward a downstream transport assembly, and permanently fix a marking particle image to a such transported receiver member, a skive mechanism including a plurality of skive members for stripping a receiver member adhering to either one of such fuser assembly rollers, from said roller, and a mounting for said skive mechanism, said skive mechanism mounting comprising:

means for supporting said skive mechanism, said skive mechanism supporting means including a bracket assembly attached to said downstream transport assembly, a pair of pivot shafts, associated with said pair of rollers of said fuser assembly respectively, said pair of pivot shafts being carried by said bracket assembly, skive members of said skive mechanism being associated with said pivot shafts respectively;

means for selectively moving said skive members about said associated pivot shafts into operative relation with said pair of rollers respectively, adjacent to said travel path; and means for urging said skive members in a direction, in opposition to the selective movement of said skive members by said moving means from said operative relation with said pair of rollers toward a location remote from said travel path, whereby clearance of receiver member jams in said fuser assembly is facilitated, said urging means for said skive members including a first link connected at one end to said skive members associated with one roller of said fuser assembly, a second link connected at one end to said skive members associated with the other roller of said fuser assembly, means for connecting said first and second links together at the respective other ends thereof to form a knuckle joint, and means for impelling said links to move in a direction, relative to said bracket assembly, to rotate said skive members respectively in a first direction about their associated pivot shafts.

13. The skive mechanism mounting according to claim 12 wherein said skive member selective moving means includes means for moving said links, relative to said bracket assembly, to rotate said skive members in a second direction about their associated pivot shafts, substantially opposite said first direction, to locate said skive members in such operative relation with respective fuser assembly rollers.

14. The skive mechanism mounting according to claim 13 wherein said link moving means includes a stop member positioned at a predetermined location relative to said fuser assembly roller, said stop member adapted to become engaged with said knuckle joint of said links when said downstream transport assembly is located in operative relation to said receiver member travel path.

15. The skive mechanism mounting according to claim 14 wherein said urging means for said skive members further includes means for impelling said skive members to rotate in said respective second directions about their associated pivot shafts, subsequent to said skive members being rotated in said first directions, when said downstream transport assembly is moved out of operative relation with said receiver member travel path.

16. The skive mechanism mounting according to claim 15 wherein said impelling means includes a spring assembly connected to said skive mechanism and operative only when said downstream transport assembly is moved out of operative relation with said receiver member travel path.

17. The skive mechanism mounting according to claim 12 wherein one end of said first link is attached to said skive members associated with said one roller at a fixed predetermined radial distance from the longitudinal axis of the associated pivot shaft, and one end of said second link is attached to said skive members associated with said other roller at a fixed predetermined radial distance from the longitudinal axis of the associated pivot shaft, the opposite ends of said first and second links connected together to form a knuckle joint, said knuckle joint being constrained to move in a direction perpendicular to a plane including the longitudinal axis of said pivot shafts whereby, as said links are moved by said selective moving means in a particular direction, said skive mechanisms rotate in a corresponding direction about their associated pivot shafts.

18. The skive mechanism mounting according to claim 17 wherein said urging means for said skive members further includes a tension spring member attached to said links intermediate said ends thereof to urge said links for movement in said respective first directions.

19. The skive mechanism mounting according to claim 18 wherein said skive member selective moving means includes a stop member positioned at a predetermined location relative to said fuser assembly rollers, said stop member adapted to become engaged with said knuckle joint of said links for moving said links respectively when said downstream transport assembly is located in operative relation to said receiver member travel path, relative to said bracket assembly, in a second direction substantially opposite said first direction to locate said skive members in such operative relation with said respective fuser assembly rollers by rotation of said skive members about their associated pivot shafts.

20. The skive mechanism mounting according to claim 19 wherein said urging means for said skive members further includes means for impelling said skive members to rotate in said respective second directions about their associated pivot shafts, subsequent to said skive members being rotated in said first directions, when said downstream transport assembly is moved out of operative relation with said receiver member travel path.

21. The skive mechanism mounting according to claim 20 wherein said impelling means includes a spring assembly connected to said skive mechanism and operative only when said downstream transport assembly is moved out of operative relation with said receiver member travel path.

22. The skive mechanism mounting according to claim 12 wherein said bracket assembly includes a first bracket pivotably supported for rotation about the longitudinal axis of one of said pair of rollers of said fuser assembly, a first pivot shaft of said pair of pivot shafts being supported by said first bracket; and a second bracket attached to the support for the other of said pair of rollers of said fuser assembly, a second pivot shaft of said pair of pivot shafts being supported by said second bracket.

23. The skive mechanism mounting according to claim 22 wherein said urging means includes a spring adapted to engage said first bracket and urge said first bracket to rotate in a first direction about the longitudinal axis of said one roller to locate said associated skive members in operative relation with said one roller.

24. The skive mechanism mounting according to claim 23 wherein said moving means includes means for moving said spring to a remote location, out of engagement with said first bracket, so as to enable said first bracket to rotate in a second direction, substantially opposite said first direction, under the influence of gravitational forces, about the longitudinal axis of said one roller to locate said associated skive members out of operative relation with said one roller.

25. The skive mechanism mounting according to claim 24 wherein said moving means further includes a stop member for limiting rotation of said first bracket in said second direction.

26. The skive mechanism mounting according to claim 25 further including a guide plate having a marginal edge in juxtaposition with the peripheral surface of said one roller, said guide plate having a portion at an elevation below the elevation of the plane of said associated skive members when said skive members are in operative relation with said one roller, and at an elevation above the elevation of the plane of said associated skive members when said first bracket supporting said skive members is in engagement with said stop member and said skive members are out of operative relation with said one roller.

27. The skive mechanism mounting according to claim 24 wherein said spring is attached to said downstream transport assembly.

28. The skive mechanism mounting according to claim 27 wherein said moving means further includes a stop member for limiting rotation of said first bracket in said second direction.

29. The skive mechanism mounting according to claim 28 further including a guide plate having a marginal edge in juxtaposition with the peripheral surface of said one roller, said guide plate having a portion at an elevation below the elevation of the plane of said associated skive members when said skive members are in operative relation with said one roller, and at an elevation above the elevation of the plane of said associated skive members when said first bracket supporting said skive members is in engagement with said stop member and said skive members are out of operative relation with said one roller.

30. A fuser assembly including at least one roller for transporting a receiver member along a travel path, toward a downstream transport assembly, and permanently fix a marking particles image to a such transported receiver member, a skive mechanism for stripping a receiver member adhering to said fuser assembly roller from such roller, and a mounting for said skive mechanism, said skive mechanism mounting comprising:

a bracket attached to said downstream transport assembly and a pivot shaft carried by said bracket, said skive mechanism being supported by said pivot shaft;

means for selectively moving said skive mechanism about said pivot shaft into operative relation with said fuser assembly roller adjacent to said travel path; and means for urging said skive mechanism in a direction, in opposition to the selective movement of said skive mechanism by said moving means, from said operative relation with said fuser assembly roller toward a location remote from said travel path, whereby clearance of receiver member jams in said fuser assembly is facilitated, said urging means for said skive mechanism including a link connected to said skive mechanism, means for impelling said link to move in a direction, relative to said bracket, to rotate said skive mechanism in a first direction about said pivot shaft, and said skive mechanism selective moving means including means for moving said link, relative to said bracket, to rotate said skive mechanism in a second direction about said pivot shaft, substantially opposite said first direction, to locate said skive mechanism in such operative relation with said fuser assembly roller, said link moving means including a stop member positioned at a predetermined location relative to said fuser assembly roller, said stop member adapted to become engaged with said link when said downstream transport assembly is located in operative relation to said receiver member travel path.

31. The skive mechanism mounting according to claim 30 wherein said urging means for said skive mechanism further includes means for impelling said skive mechanism to rotate in said second direction about said pivot shaft, subsequent to said skive mechanism being rotated in said first direction, when said downstream transport assembly is moved out of operative relation with said receiver member travel path.

32. The skive mechanism mounting according to claim 31 wherein said impelling means includes a spring assembly connected to said skive mechanism and operative only when said downstream transport assembly is moved out of operative relation with said receiver member travel path.

33. The skive mechanism mounting according to claim 30 wherein one end of said link is attached to said skive mechanism at a fixed predetermined radial distance from the longitudinal axis of said pivot shaft, and the opposite end of said link is constrained to move in a direction perpendicular to a plane including the longitudinal axis of said pivot shaft whereby, as said link is moved by said selective moving means in a particular direction, said skive mechanism rotates in a corresponding direction about said pivot shaft.

34. The skive mechanism mounting according to claim 33 wherein said urging means for said skive mechanism further includes a spring member attached to said link intermediate said ends thereof to urge said link for movement in a first direction.

35. The skive mechanism mounting according to claim 34 wherein said stop member, upon engagement with said link, moves said link when said downstream transport assembly is located in operative relation to said receiver member travel path, relative to said bracket, in a second direction substantially opposite said first direction to locate said skive mechanism in such operative relation with said fuser assembly roller by rotation of said skive mechanism about said pivot shaft.

36. The skive mechanism mounting according to claim 35 wherein said urging means for said skive mechanism further includes means for impelling said skive mechanism to rotate in said second direction about said pivot shaft, subsequent to said skive mechanism being rotated in said first direction, when said downstream transport assembly is moved out of operative relation with said receiver member travel path.

37. The skive mechanism mounting according to claim 36 wherein said impelling means includes a spring assembly connected to said skive mechanism and operative only when said downstream transport assembly is moved out of operative relation with said receiver member travel path.

* * * * *